US008215976B2

(12) United States Patent
Peng et al.

(10) Patent No.: US 8,215,976 B2
(45) Date of Patent: Jul. 10, 2012

(54) POWER ADAPTER WITH REPLACEABLE PLUG

(75) Inventors: Jiu-Cheng Peng, Shenzhen (CN); Ping-Chou Chen, New Taipei (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/194,994

(22) Filed: Jul. 31, 2011

(65) Prior Publication Data

US 2012/0142208 A1 Jun. 7, 2012

(30) Foreign Application Priority Data

Dec. 4, 2010 (CN) ..... 2010 1 0574528

(51) Int. Cl.
*H01R 4/50* (2006.01)

(52) U.S. Cl. ..... 439/345; 439/173; 439/518

(58) Field of Classification Search ..... 439/345, 439/166, 171–177, 217, 218, 518, 956
See application file for complete search history.

(56) References Cited

U.S. PATENT DOCUMENTS

| | | | | |
|---|---|---|---|---|
| 5,848,907 | A * | 12/1998 | Chen | 439/172 |
| 7,008,246 | B2 * | 3/2006 | Zhuge | 439/173 |
| 7,168,969 | B1 * | 1/2007 | Wang | 439/173 |
| 7,179,105 | B1 * | 2/2007 | Hung | 439/172 |
| 7,300,297 | B1 * | 11/2007 | Wang | 439/173 |
| 7,563,115 | B2 * | 7/2009 | van gen Hassend et al. | 439/171 |
| 7,621,765 | B1 * | 11/2009 | Wu | 439/173 |
| 2005/0176281 | A1 * | 8/2005 | Zhuge | 439/173 |

* cited by examiner

*Primary Examiner* — Tulsidas C Patel
*Assistant Examiner* — Travis Chambers
(74) *Attorney, Agent, or Firm* — Altis Law Group, Inc.

(57) ABSTRACT

A power adapter includes a base with a cord, an internal circuit electrically connected to the cord and first terminals connected to the internal circuit, and a locking member with a connection portion fixed to the base and an elastic portion connected to the connection portion. The elastic portion comprises a protruding latching portion. The power adapter also includes a plug with second terminals exposed at a first side thereof and a chamber defined in an opposite second side. Each of the second terminals includes an end portion received in the chamber, and the chamber includes an internal sidewall defining a recessed portion snappingly engaging with the latching portion, thereby detachably securing the plug to the base.

7 Claims, 9 Drawing Sheets

POWER ADAPTER WITH REPLACEABLE PLUG

BACKGROUND

1. Technical Field

The present disclosure relates to power adapters, especially to a power adapter that has a replaceable plug.

2. Description of Related Art

Electrical appliances usually include a plug of fixed size to be inserted into a wall socket. However, because of the fixed size, the plugs can only fit one kind of socket, and so are not versatile.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below, with reference to the accompanying drawings.

Figure 1:
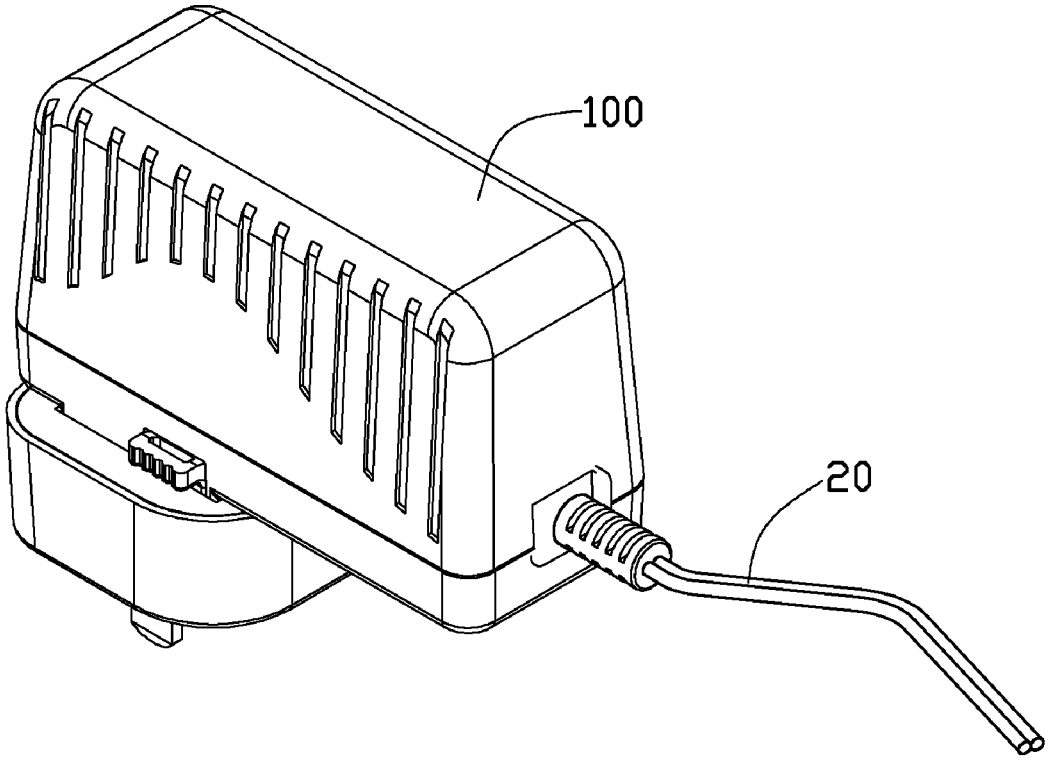
FIG. 1 is an isometric view of a power adapter in accordance with one embodiment.
Figure 2:
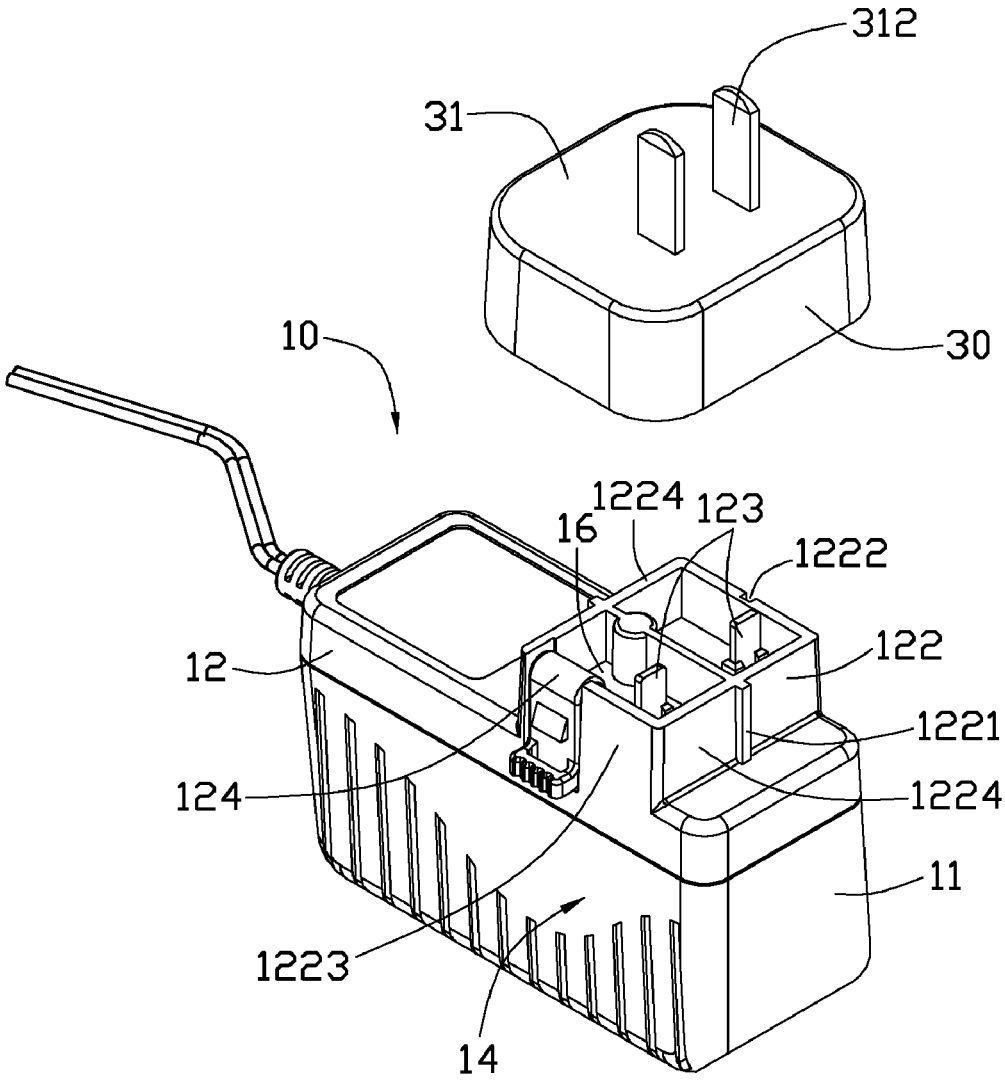
FIG. 2 is an exploded perspective view of the power adapter of FIG. 1.

As shown in FIGS. 1 and 2, a power adapter 100 includes a base 10 and a plug 30. The base 10 is hollow and includes a cord 20, a bottom housing 11 and a cover 12 connected to the bottom housing 11. A protruding portion 122 protrudes from the top of the cover 12 and includes a number of peripheral sidewalls connected end to end. A bottom face 16 of the protruding portion 122 is formed with two elastic terminals 123 extending through the cover 12 and surrounded by the sidewalls. Each of the two elastic terminals 123 has a first end portion connected to the cord 20 through an internal circuit 14 mounted in the base 10, and a second end protruding from the bottom face 16. The other end of internal circuit 14 is electrically connected to the cord 20.

Figure 3:
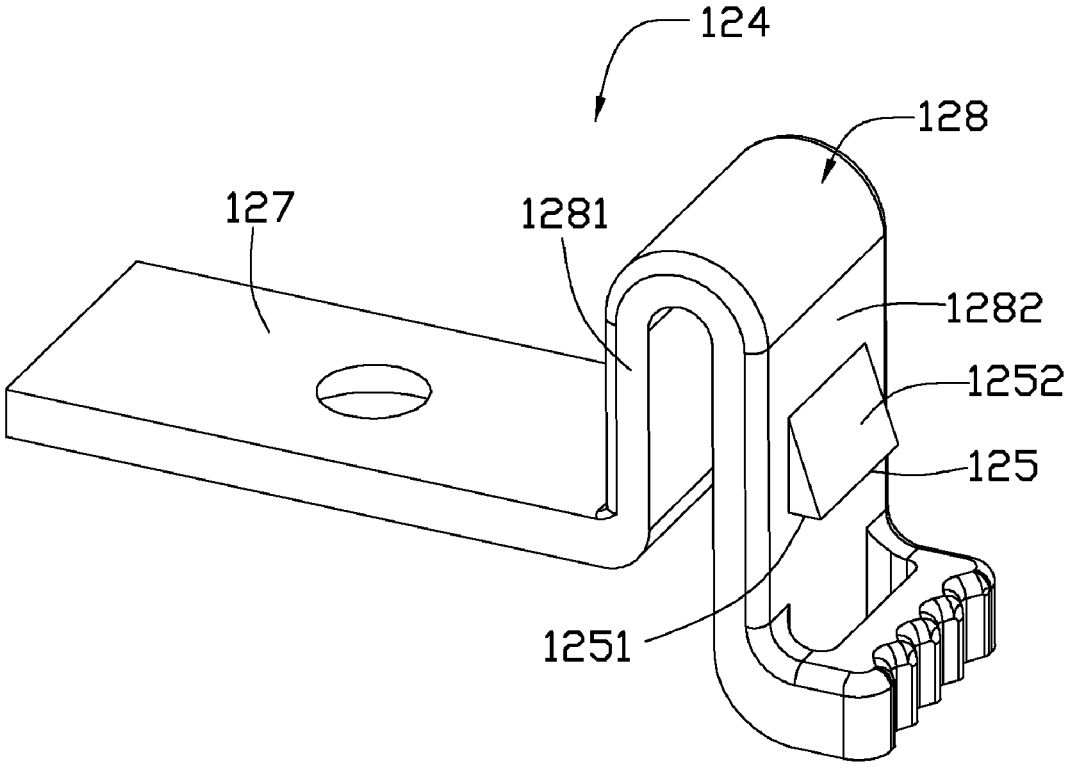
FIG. 3 is an isometric view showing a locking member of the power adapter of FIG. 1.

One wall 1223 of the protruding portion 122 defines an opening that receives a flexible locking member 124. The two walls 1224 at opposite sides of the wall 1223 each include a slide rail 1221 that protrudes from an outer surface thereof and is substantially perpendicular to the bottom face 16. As shown in FIG. 3, the flexible locking member 124 includes a connection portion 127 and an elastic portion 128 connected to the connection portion 127. The elastic portion 128 includes a first arm 1281 protruding from one end of the connection portion 127. In the embodiment, the first arm 1281 is substantially perpendicular to the connection portion 127. The elastic portion 128 further includes a second arm 1282 connected to the first arm 1281. A gap is formed between the first and the second arms 1281, 1282, thereby allowing the second arm 1282 to be elastically deformed. The second arm 1282 includes a latching member 125 protruding therefrom. In the embodiment, the latching member 125 is wedge-shaped and includes an inclined surface 1252 and an engaging end surface 1251.

Figure 4:
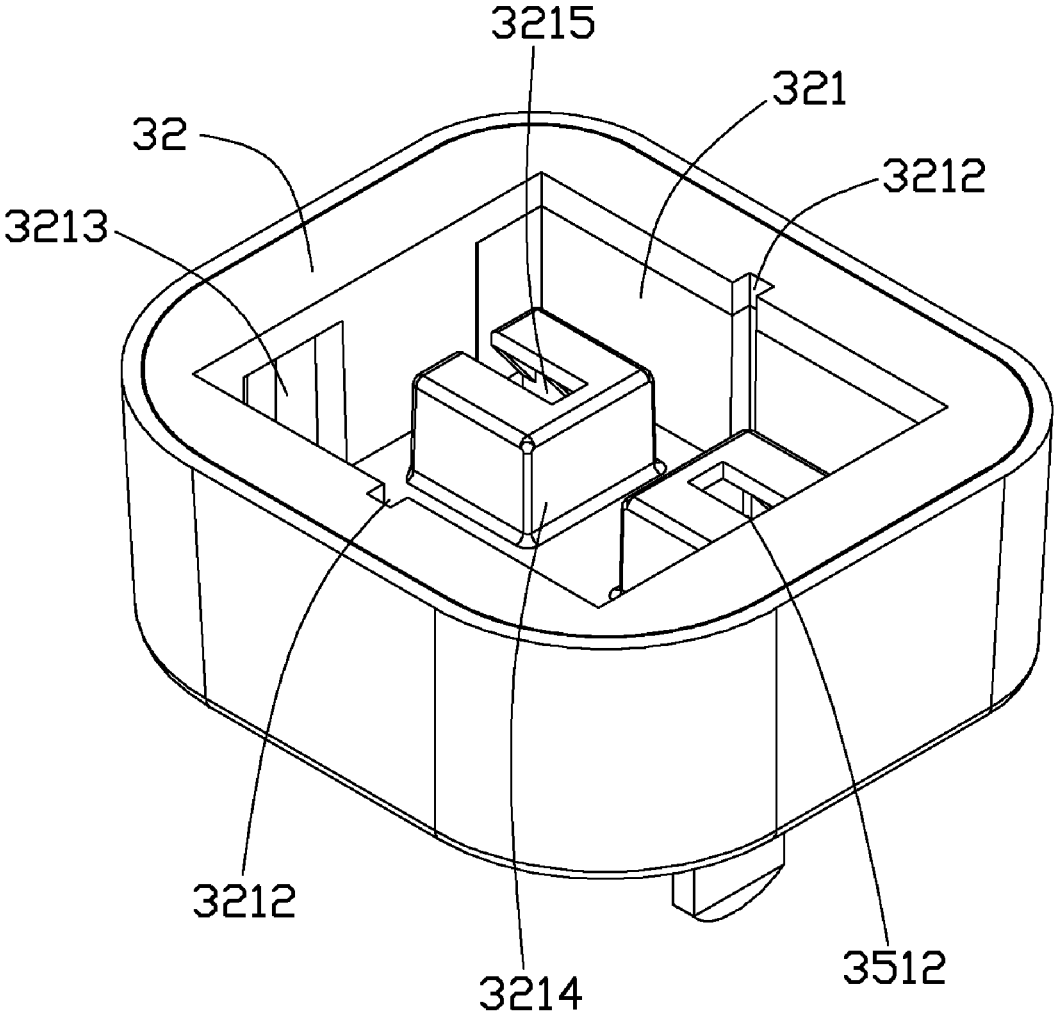
FIG. 4 is an isometric view showing a plug of the power adapter of FIG. 1.

As shown in FIGS. 2 and 4, the plug 30 includes a first end face 31 and a second end face 32. Two spaced protruding terminals 312 protrude from the first end face 31. A chamber 321 is defined in the second end face 32. Two guiding grooves 3212 are respectively formed in two opposite sidewalls of the chamber 321, and can slidably engaged with the slide rails 1221 of the base 10, thereby guiding the plug 30 to move with respect to the base 10. A recessed portion 3213 is defined in a sidewall of the chamber 321. Two sockets 3214 are formed on the bottom of the chamber 321. One end of each terminal 312 is received in one of the sockets 3214 correspondingly. Each sockets 3214 defines a slot 3215 that allows one terminal 123 of the base 10 to fit thereinto to contact one terminal 312.

Figure 5:
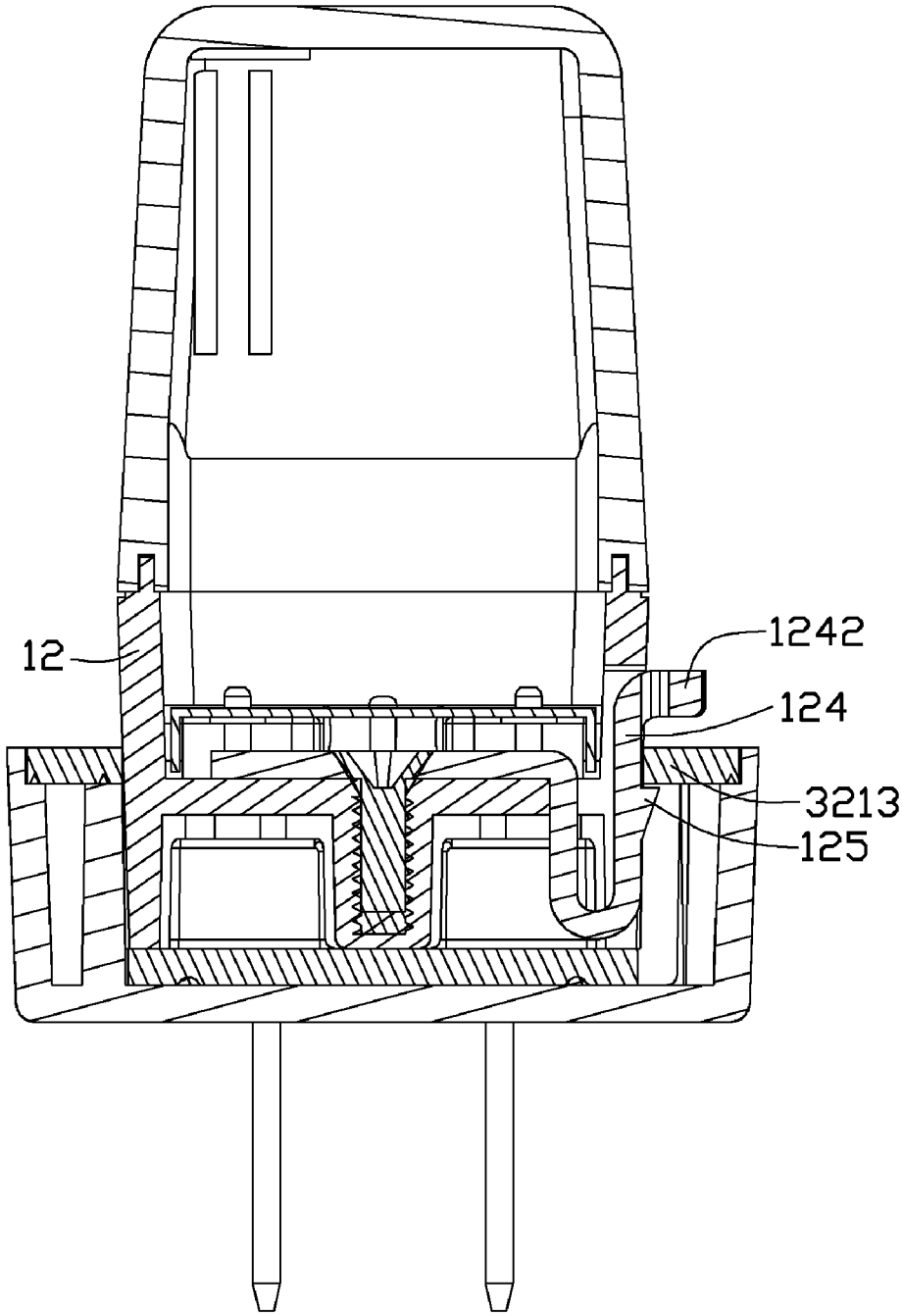
FIG. 5 is a sectional view of the power adapter of FIG. 1.

As shown in FIG. 5, after the plug 30 is connected to the base 10, the protruding portion 122 is received in the chamber 321, and the latching member 125 is snapped into the recessed portion 3213. The upper wall of the recessed portion 3213 engages with the engaging end surface 1251 and prevents the plug 30 from disengaging from the base 10. Each of the protruding terminals 312 contacts one of the two elastic terminals 123, thereby electrically connecting the terminals 312 to the internal circuit 14.

Figure 6:
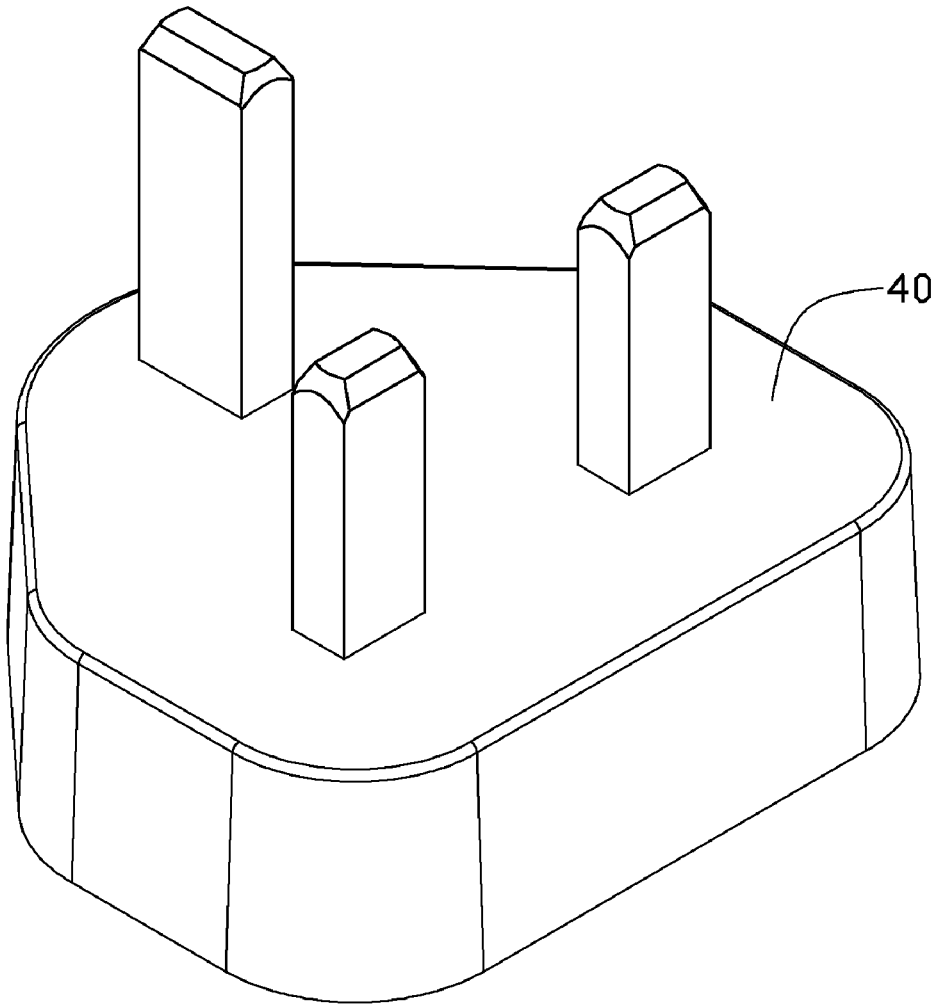
FIG. 6 is an isometric view showing a plug for use with the power adapter of FIG. 1 according to a second embodiment.
Figure 7:
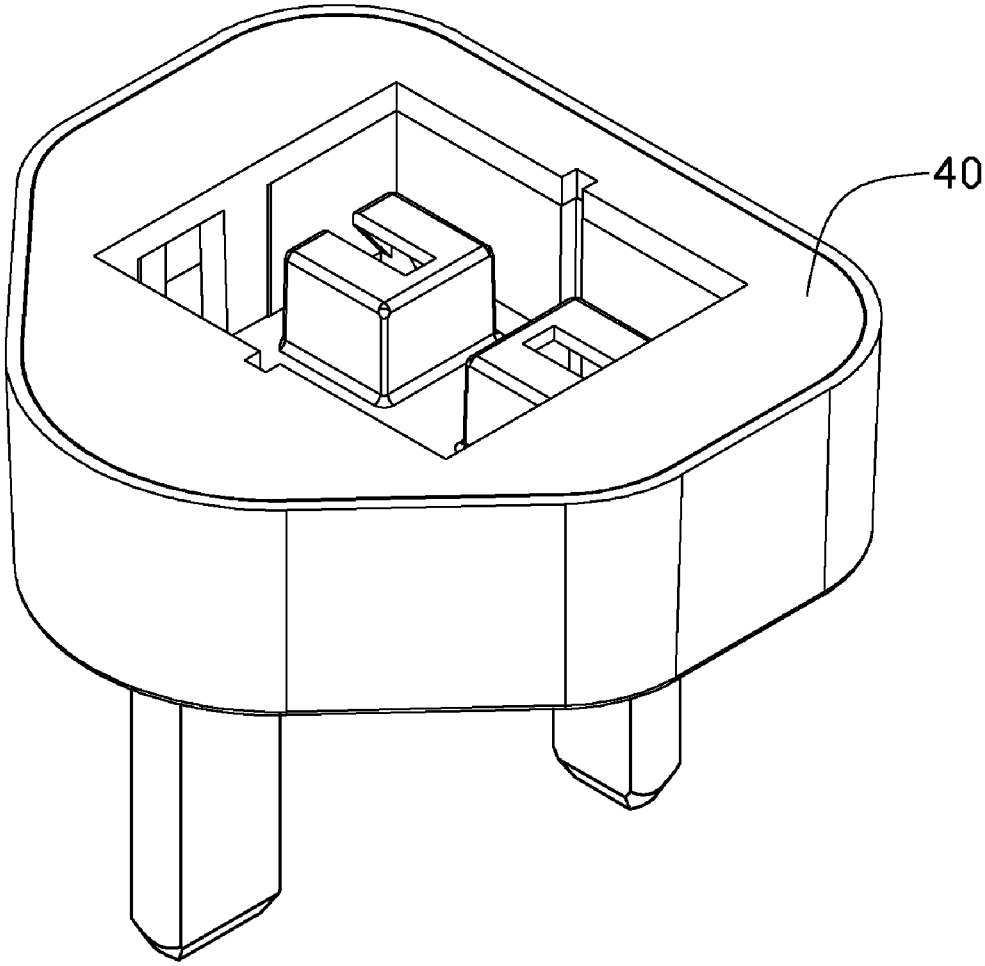
FIG. 7 is similar to FIG. 6, but viewed from a different viewpoint.
Figure 8:
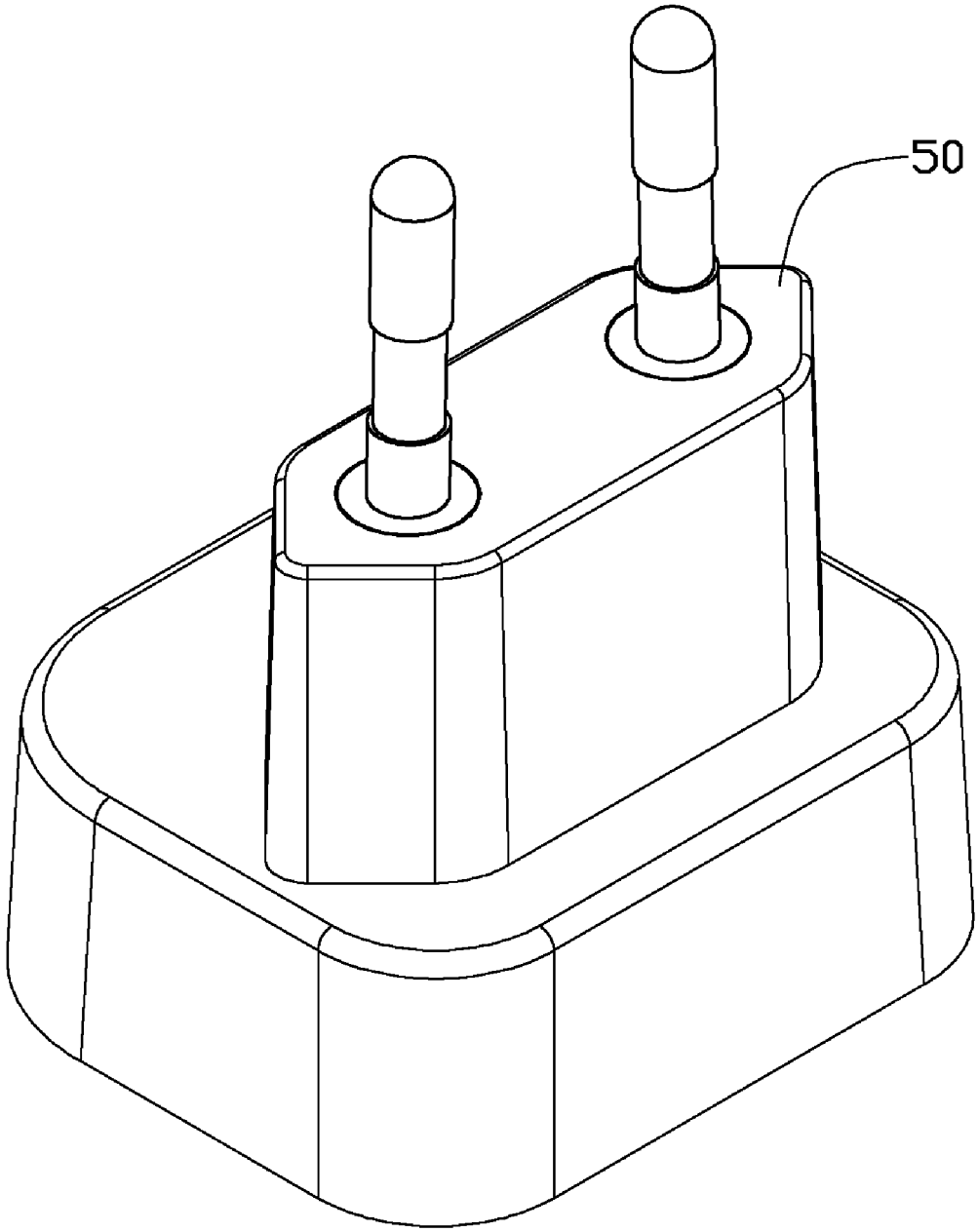
FIG. 8 is an isometric view showing a plug for use with the power adapter of FIG. 1 according to a third embodiment.
Figure 9:
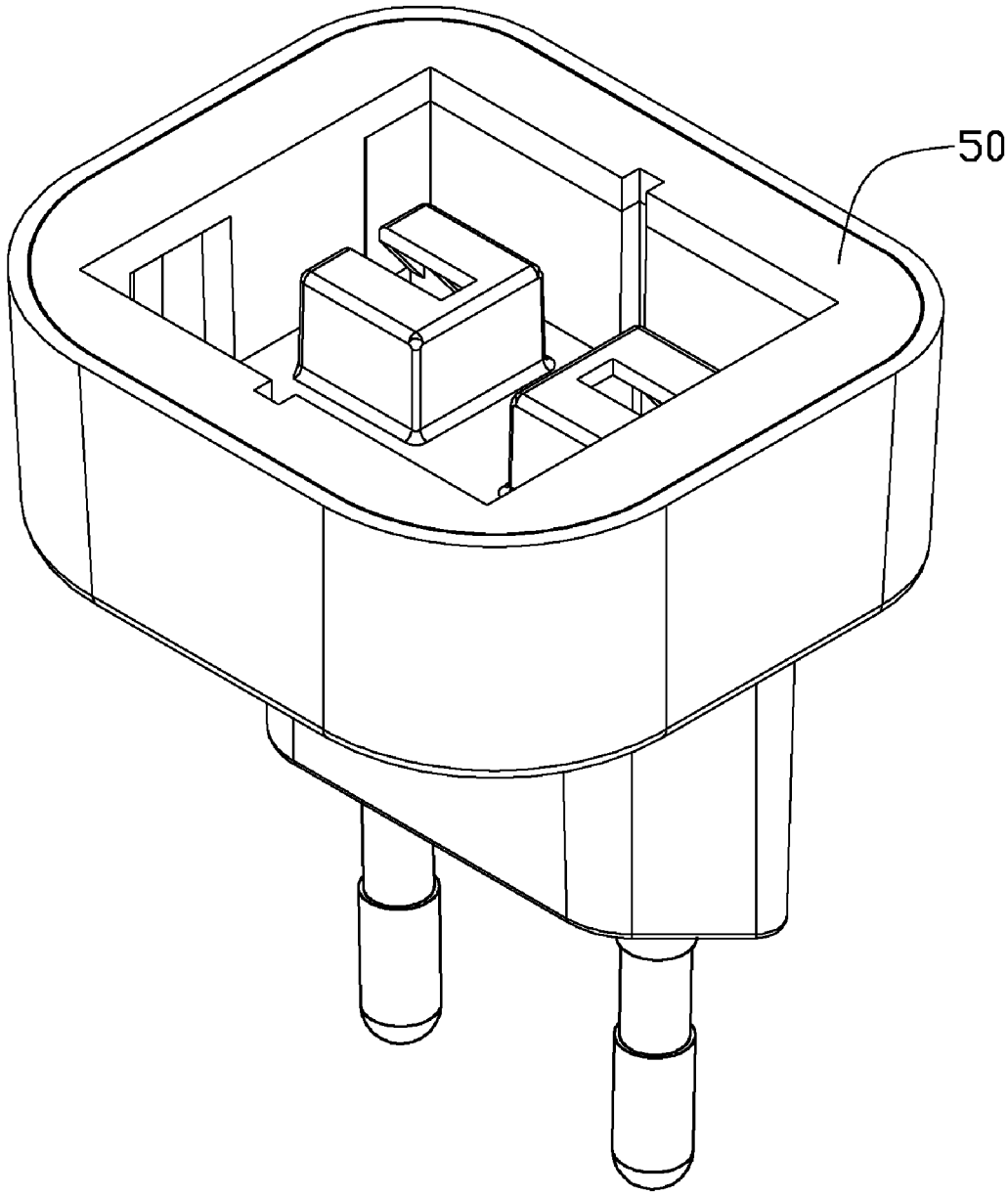
FIG. 9 is similar to FIG. 8, but viewed from a different viewpoint.

When attempting to replace the plug 30, a user can push the end of the flexible locking member 124, thereby releasing the latching member 125 from limiting movement of the plug 30. The plug 30 can then be detached from the base 10. The plug 30 can be replaced by a plug 40 having three terminals (see FIGS. 6 and 7) or another two-terminal plug 50 (see FIG. 8 and FIG. 9).

It is to be noted that the power cable plug assembly having the replaceable plug in accordance with the present invention can be applied to different sizes or types of power sockets, since the plug can be replaced according to need.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A power adapter comprising:

a base comprising a cord, an internal circuit electrically connected to the cord, and a plurality of first terminals connected to the internal circuit;

a locking member comprising a connection portion fixed to the base and an elastic portion connected to the connection portion, the elastic portion comprising a first arm and a second arm connected to the first arm, the first arm protruding from the connection portion, the second arm comprising a latching member protruding therefrom, a gap formed between the first and the second arms to allow the second arm to be elastically deformed relative to the first arm; and a plug comprising a plurality of second terminals exposed at a first side thereof and a chamber defined in an opposite second side, each of the second terminals comprising an end portion received in the chamber, the chamber comprising an internal sidewall defining a recessed portion snappingly engaging with the latching portion, thereby detachably securing the plug to the base, the plurality of first terminals contact the respective second terminals, thereby allowing power transmitting from the first terminals to the cord through the internal circuit.

2. The power adapter of claim 1, wherein the latching member is wedge-shaped.

3. The power adapter of claim 1, wherein two guiding grooves are respectively formed in two opposite sidewalls of the chamber, and the base comprises two rails slidably engaged in the respective guiding grooves.

4. The power adapter of claim 1, wherein two sockets are formed on the bottom of the chamber, the second terminals received in the respective sockets, and each sockets defines a slot configured for allowing the corresponding first terminal to fit thereinto to contact the second terminal.

5. The power adapter of claim 1, wherein the base comprises a bottom housing, the internal circuit is mounted in the bottom housing.

6. The power adapter of claim 5, wherein the base further comprises a cover covering the bottom housing, a protruding portion protrudes from the cover and comprises a plurality of peripheral sidewalls connected end to end, the first terminals extending through the cover and surrounded by the sidewalls.

7. A power adapter assembly comprising:

a base comprising a first housing, a cord connected to the housing, an internal circuit received in the first housing and electrically connected to the cord, and a plurality of first terminals connected to the internal circuit; and a plurality of plugs each comprising a second housing for detachably mechanically coupled to the base, and a plurality of second terminals having first ends protruding beyond the second housing, and opposite second ends for electrically contacting the corresponding first terminals, wherein the base comprises a spring locking member configured for selectively resiliently securing one of the plugs to the base, the spring locking member comprising a connection portion fixed to the base and an elastic portion connected to the connection portion, the elastic portion comprising a first arm and a second arm connected to the first arm, the first arm protruding from the connection portion, the second arm comprising a latching member protruding therefrom, a gap formed between the first and the second arms to allow the second arm to be elastically deformed relative to the first arm, the configuration or arrangement of the second terminals of the plugs are different from each other.

* * * * *